US006034481A

United States Patent [19]

Haynes

[11] Patent Number: 6,034,481

[45] Date of Patent: Mar. 7, 2000

[54] ELECTROLUMINESCENT DISPLAY WITH INDEPENDENTLY ADDRESSABLE PICTURE ELEMENTS

[75] Inventor: Bryan D. Haynes, Pacifica, Calif.

[73] Assignee: Add-Vision, Inc., Pacifica, Calif.

[21] Appl. No.: 09/115,621

[22] Filed: Jul. 13, 1998

Related U.S. Application Data

[63] Continuation-in-part of application No. 08/910,724, Aug. 13, 1996.

[51] Int. Cl.[7] ..... G09G 3/10

[52] U.S. Cl. ..... 315/169.3; 315/169.1; 345/76; 40/544

[58] Field of Search ..... 315/169.3, 169.4, 315/169.1; 345/76, 77, 84; 313/498, 503, 519; 40/544, 541

[56] References Cited

U.S. PATENT DOCUMENTS

| | | | |
|---|---|---|---|
| 4,646,079 | 2/1987 | Kitai et al. | 345/81 |
| 4,897,802 | 1/1990 | Atkinson et al. | 40/362 |
| 5,410,217 | 4/1995 | LaPointe | 313/509 |
| 5,440,214 | 8/1995 | Peeters | 318/685 |
| 5,459,954 | 10/1995 | Bronaugh et al. | 40/476 |
| 5,513,458 | 5/1996 | Dehli | 40/470 |
| 5,598,058 | 1/1997 | LaPointe | 313/503 |
| 5,621,502 | 4/1997 | Bronaugh et al. | 355/79 |
| 5,638,156 | 6/1997 | Dehli | 355/72 |
| 5,657,565 | 8/1997 | Dehli | 40/476 |

*Primary Examiner*—Haissa Pilogene
*Attorney, Agent, or Firm*—Pillsbury Madison & Sutro LLP

[57] ABSTRACT

An apparatus displaying a sequence of images on an electroluminescent lamp is disclosed. The apparatus includes an electroluminescent lamp, a plurality of trace leads, and an overlay adjacent to the electroluminescent lamp. The lamp has a front electrode and a plurality of pixels, the pixels being independently illuminable portions of the lamp, and each pixel includes an electroluminescent material and a rear electrode. The trace leads are connected to the rear electrodes, with each rear electrode connected to one trace lead and each trace lead connected to more than one rear electrode. The overlay has a translucent or transparent material and a plurality of images interwoven together on the translucent or transparent material. Each image corresponds to selected pixels on the lamp. Power supplied to the front electrode and selected rear electrodes creates an electric field therebetween, whereby pixels to which power is supplied are illuminated to display an image. A sequence of the images may be displayed by successively selecting other of the rear electrodes. Such a sequence of images may form animation.

20 Claims, 12 Drawing Sheets

Frame 1

610

Frame 2

620

Frame 3

630

Frame 4

640

Frame 1

710

Frame 2

720

Frame 3

730

Frame 4

740

Frame 1

810

Frame 2

820

Frame 3

830

Frame 4

840

912

Frame 1 Merged With Frame 2

913

Frame 3 Merged With Frames 1 and 2

914

Frame 4 completing the image.

ELECTROLUMINESCENT DISPLAY WITH INDEPENDENTLY ADDRESSABLE PICTURE ELEMENTS

CROSS-REFERENCE TO RELATED APPLICATIONS

This application is a continuation-in-part of U.S. patent application Ser. No. 08/910,724, filed Aug. 13, 1996.

BACKGROUND OF THE INVENTION

1. Field of the Invention

The present invention relates to electroluminescent displays capable of showing more than one image, or of showing a series of images forming animation. In particular, the invention relates to electroluminescent displays capable of showing more than one image, or showing a series of images forming animation, on one lamp.

2. Description of the Related Art

Electroluminescent ("EL") lamps are light sources that contain a special phosphor or combination of phosphors that luminesce in the presence of an electric field. The electric field is generated by electrodes having the phosphor between them. At least one electrode is foraminous, transparent or translucent so the EL lamp can project the light the phosphor emits.

EL lamps have a number of advantages, including brightness, long life, thinness, low cost, and low power consumption.

An EL lamp may display a series of images forming animation. Each image in the series is termed a frame of animation. Typically, the animation is implemented by a number of EL lamps placed alongside each other with the animation divided into one frame on each lamp. By successively activating adjacent lamps, the images appear to be in motion. Such animation may also be implemented by a number of electrically-isolated rear electrodes within a single lamp structure.

However, the animation described above is linear. That is, the frames of animation appear to move (jump) from one lamp to the next. Such a linear arrangement fails to allow stationary animation, that is, animation that appears to remain in one location. Furthermore, each lamp is able to show only one image.

SUMMARY OF THE INVENTION

The present invention addresses these and other problems of the prior art by providing an EL lamp having a plurality of picture elements ("pixels") and a composite image overlying the pixels. The pixels are arranged into independently illuminable sets of pixels. Several images interwoven together, each image corresponding to a set of pixels, form the composite image. Each of the images may be displayed by illuminating its corresponding set of pixels. From a short distance away from the lamp, a person viewing the images perceives that the separate images occupy the same space.

According to one embodiment, an apparatus according to the present invention displays a sequence of images on an electroluminescent lamp, and includes an electroluminescent lamp, a plurality of trace leads, and an overlay adjacent to the electroluminescent lamp. The lamp has a front electrode and a plurality of pixels, the pixels being independently illuminable portions of the lamp, and each pixel includes an electroluminescent material and a rear electrode. The trace leads are connected to the rear electrodes, with each rear electrode connected to one trace lead and each trace lead connected to more than one rear electrode. The overlay has a translucent or transparent material and a plurality of images interwoven together on the translucent or transparent material. Each image corresponds to respective pixels on the lamp. Power supplied to the front electrode and selected rear electrodes creates an electric field therebetween, whereby pixels to which power is supplied are illuminated to display one of the images. A sequence of the images may be displayed by sequentially supplying power to other of the rear electrodes.

Such a sequence of images may form animation.

According to another embodiment of the present invention, a method of displaying a sequence of images on an electroluminescent lamp includes the steps of providing an electroluminescent lamp including a number of pixels and a number of images interwoven together (where each of the images corresponds to a set of the pixels), and sequentially illuminating each set to display a corresponding sequence of the images. The pixels are independently illuminable portions of the lamp.

DETAILED DESCRIPTION OF THE PREFERRED EMBODIMENTS

Electroluminescent Lamps

Figure 1A:
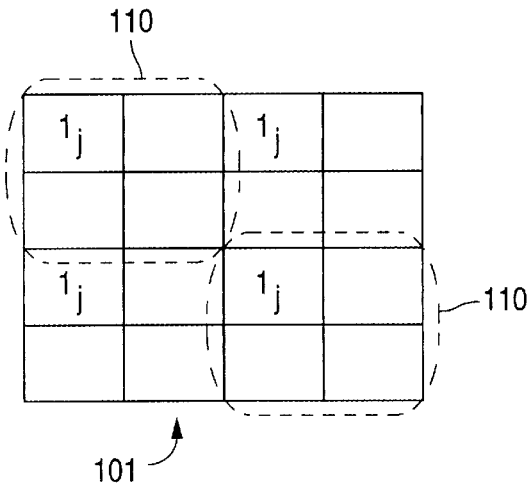
FIG. 1 is a schematic view of four grids composed of four groups of four pixels according to the present invention.
Figure 1B:
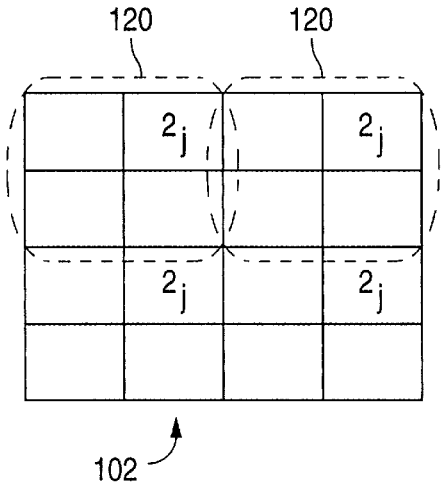
Figure 1C:
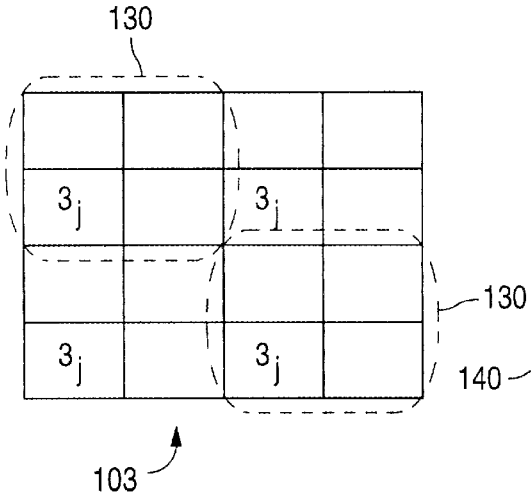
Figure 1D:
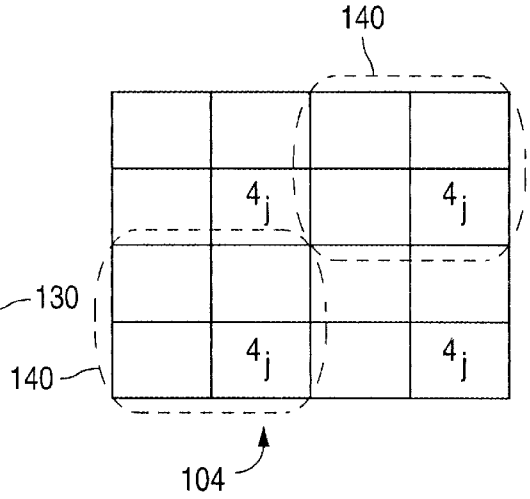

Suitable EL lamps for the present invention are described in U.S. patent application Ser. No. 08/910,724 entitled "Electroluminescent Lamp Designs", filed Aug. 13, 1996, commonly owned by the assignee of the present application, the disclosure of which is incorporated herein by reference.

In general, EL lamps include a front electrode, a rear electrode, and an electroluminescent material between the electrodes. The electroluminescent material emits light when the electrodes generate an electric field. A dielectric may optionally be between the front electrode and the electroluminescent material. An optional substrate may provide protection and structural support on the outside of the front electrode. An optional nonconductor may provide protection and structural support on the outside of the rear electrode.

The advantages of EL lamps include brightness, low cost, low power consumption, thinness, flexibility, and long life. However, principles similar to those disclosed in the present application may be applied to other EL lamps.

Electroluminescent Lamp with Pixel Grid

Before discussing specific embodiments of the present invention, the general concept is discussed with reference to a specific arrangement of picture elements ("pixels"). A pixel is a light-emitting portion of an EL lamp that may be activated independently of other pixels on the lamp.

To demonstrate how several images can be interwoven to form a composite image and how a particular image can be displayed, an examplary EL lamp with a pixel grid is described. FIG. 1 shows four grids 101, 102, 103, and 104. Each grid 101–104 is configured as groups 110, 120, 130, and 140, each of which has four pixels. A group refers to an arrangement of pixels that may be outlined by a boundary line without crossing the boundary lines of other groups. In each grid 101–104, one pixel in each group is numbered (1j in group 110, 2j in group 120, 3j in group 130, and 4j in group 140), and the other three in the group are unnumbered. The numbered pixels represent illuminated pixels, and the unnumbered pixels represent unilluminated pixels.

A set of pixels refers to all the numbered pixels (one from each group) in each grid 101–104. Thus, FIG. 1 shows four sets of pixels, with each grid 101–104 containing one set (all the pixels numbered 1j, etc.). Notice that the pixels in a set can be either illuminated or unilluminated.

Imagine four images, one on each grid 101, 102, 103, and 104. The illuminated pixels emit light, which allows a quarter portion of each image above the illuminated pixels to be seen on each grid. The unilluminated pixels cause the image portions above them to remain unseen. With only one-fourth of the pixels active, each image has a lower resolution compared to an image with all pixels active. However, by increasing the brightness of the pixels, decreasing the size of each pixel, and increasing the distance to a person viewing the image, the viewer may sufficiently perceive the image at the lower resolution. Of course, increasing the number of pixels may enhance perceptibility as well.

Figure 2:
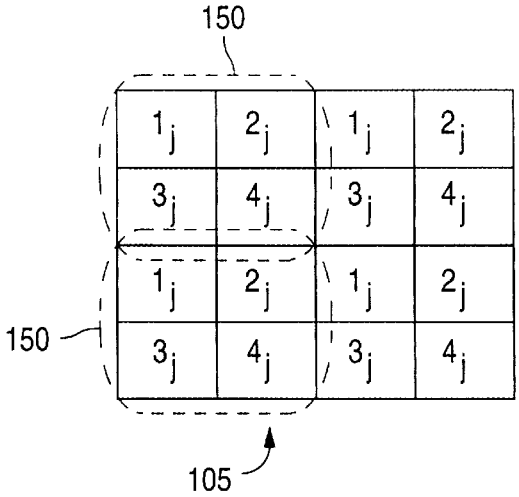
FIG. 2 is a schematic view of a combination of the four grids of FIG. 1.

Given that only one-fourth of the pixels are active when a given image is displayed, each of the four grids of FIG. 1 may be combined into one grid 105, as shown in FIG. 2. The inactive pixels in one grid may be covered with the active pixels of each of the three other grids without disrupting image display. That is, the groups of pixels 110, 120, 130, and 140 in FIG. 1 may be combined into groups 150 of pixels in FIG. 2. Thus, all four grids 101–104 may occupy the same surface area as grid 105, with each image appearing above the set of pixels which will be activated to display that image. This overlap allows four separate images to be displayed on one lamp. The images are collocated, so that a sequential display of each image may be performed without much apparent motion (jumpiness) of the images. The images may be displayed to form a sequence 1j-2j-3j-4j based on sequential illumination of sets of pixels to show animation or may show unrelated scenes.

Although FIG. 2 shows a sequence of energizing the pixels in the order 1j-2j-3j-4j following a "Z" shape in grid 105, other sequences are possible. For some applications, a row or column sequence may be used to successively energize a row 1-2-3-4 (where each set of pixels forms rows) or a column 1-2-3-4 (where each set of pixels forms columns). In animation, it may be desirable to position pixels close to each other to reduce the apparent motion (jumpiness) of the animation. Row or column sequences lack this closeness because the fourth pixel is close only to the third pixel and not the first pixel as in the sequence shown in FIG. 2. Thus for animation, the "Z" shape or a clockwise or counterclockwise arrangement may be used. For other applications, it may be desirable to have every pixel close to every other pixel in the group.

Figure 3A:
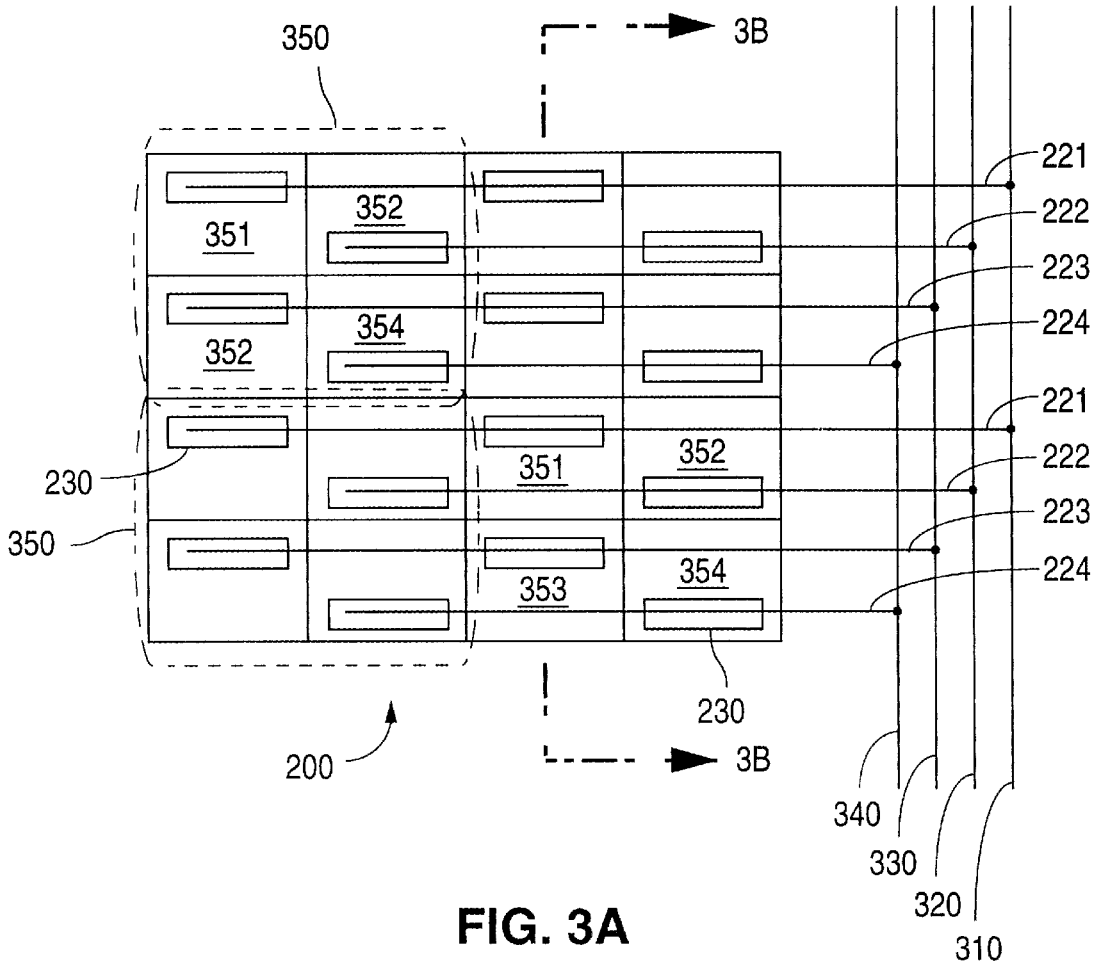
FIG. 3A is an enlarged plan view of a portion of an electroluminescent lamp arranged in a grid composed of four groups of four pixels according to a first embodiment of the present invention.

FIG. 3A shows how the individual grids 101–104 of FIG. 1 may be combined (as in grid 105 in FIG. 2) to form pixels on an EL lamp 200 according to a first embodiment of the present invention. Each pixel is a member of one of four sets 351, 352, 353, and 354. Each pixel is implemented as a square with sides of 3/16 inches. The pixels are organized into groups 350 of four pixels. For illustration purposes, FIG. 3A shows only four groups; however, in a preferred embodiment, EL lamp 200 is 24 groups by 36 groups. Of course, the size of the pixels, number of sets, and number of groups may be varied as desired.

Trace leads 221, 222, 223, and 224 supply power to the pixels, with each of the trace leads powering one set of pixels. Vias 230 permit connection of a given trace lead to selected pixels. Vias 230 provide openings for the trace leads to connect to conductive elements in lamp 200. The four trace leads power the four sets of pixels that are each activated to illuminate one-fourth of the pixels. Grid lines represent the interface between individual pixels.

The groups 350 of four pixels from EL lamp 200 are connected to four channels 310, 320, 330, and 340. The trace leads 221, 222, 223, and 224 connect every fourth pixel in the group (every other pixel horizontally) to one of the channels. In each group, the first channel 310 activates pixels 351, and the second channel 320 activates pixels 352. The third channel 330 activates pixels 353, and the fourth channel 340 activates pixels 354. Thus, each channel activates one pixel of each group; and because each pixel in each group is in one of the sets, each channel activates one set of pixels.

Figure 3B:
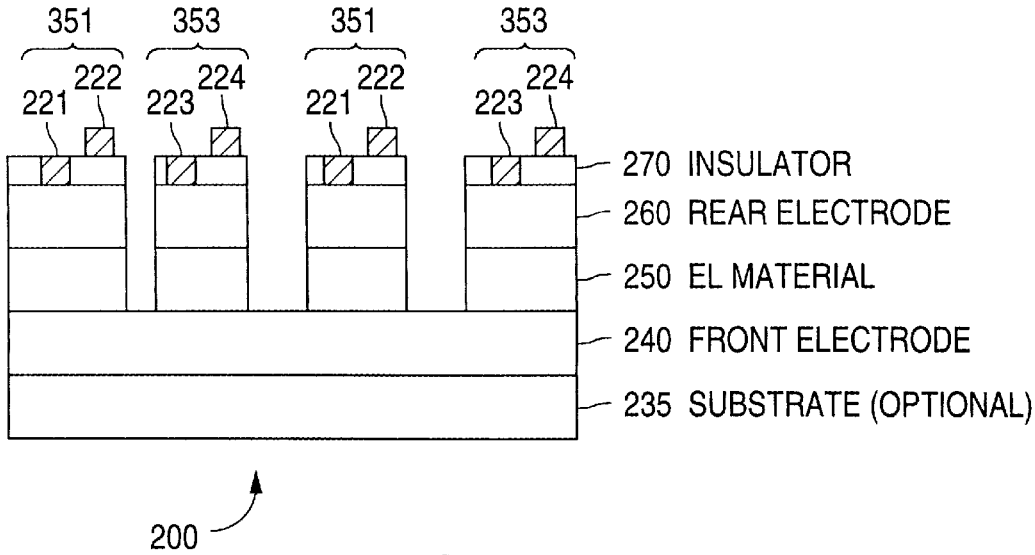
FIG. 3B is a cross-sectional view along line 3B—3B of FIG. 3A.

FIG. 3B shows a cross-sectional view of individual pixels 351, 353 of EL lamp 200 along line 3B—3B of FIG. 3A. Shown are substrate 235, front electrode 240, electroluminescent material 250, rear electrodes 260, insulators 270, and trace leads 221, 222, 223, and 224. Trace leads 221 and 223 are in vias 230 in contact with rear electrodes 260.

Substrate 235 is optional, and may be any material capable of supporting the other layers of lamp 200. In a preferred embodiment, substrate 235 is a flexible substrate such as paper, card, plastic, rubber or woven fabric. Preferred substrates include, but are not limited to, polystyrene and polyesters such as polyethylene terepthalate.

Rear electrodes 260 may be any conductive material, and is preferably silver. The rear electrodes may all share a common ground.

Electroluminescent material 250 may be selected from a number of commercially-available materials according to the desired power, frequency, and light wavelength desired. Preferably, electroluminescent material 250 is phosphor particles such as EL Phosphor Type 30, manufactured by Osram Sylvania, suspended in a matrix.

Front electrode 240 may be any transparent or translucent conductive material. For example, transparent or translucent conductive polymers may be used such as those manufactured by Acheson, product #DB2320. It is preferred that the translucent or transparent electrically conductive material is made of particles of translucent or transparent conductive material suspended in a matrix. The particles of translucent or transparent conductive material may generally be made of any translucent or transparent conductive material; for example, particles of indium tin oxide may be used. Another suitable translucent or transparent electrically conductive material may be made of a printable ITO conductor available from DuPont (product #7160) or Acheson (product #SS-24823).

Insulator 270 may be any material capable of insulating the rear electrodes from the trace leads.

Trace leads 221–224 may be any conductive material. Because the trace leads are shown in line with the electroluminescent material 250, trace leads 221–224 should have a small diameter. Suitable trace leads are about 10 mils in diameter. Because of the high electric fields desired to produce electroluminescence, these trace leads may be made smaller to increase the distance between them, which reduces the probability of short circuits. Other embodiments may contain trace leads with diameters of 5 mils.

The EL lamp 200 may be formed as known in the art, and is preferably formed by printing the layers on top of substrate 235. Preferably, insulator 270 is printed and then vias 230 are etched in insulator 270 to provide electrical contacts between the trace leads and the rear electrodes.

The EL lamp 200 operates as follows. A power supply, for example, an alternating voltage source, supplies power to channel 310. This power travels along trace leads 221 to pixels 351 and causes pixels 351 to luminesce, illuminating one-fourth of the surface of EL lamp 200. The light emitted by pixels 351 displays a first image corresponding to the illuminated quarter of EL lamp 200. After a desired period of time, the alternating voltage supply stops powering channel 310 and instead powers channel 320. This activates pixels 352, displaying a second image corresponding to the second illuminated quarter. Similarly, the alternating voltage supply powers channel 330 and pixels 353, and channel 340 and pixels 354.

Thus, providing power to a given channel provides power to all the trace leads connected to that channel, which activates one-fourth of the pixels, which is one set of pixels. By sequential activation of the channels in the order 310, 320, 330, and 340, the four pixels 351, 352, 353, and 354 in each group 350 are sequentially activated in a "Z" shape. The activation period of the channels may be increased or decreased, as desired, to form animation. For example, the activation period may be increased to give the illusion of motion.

Figure 4:
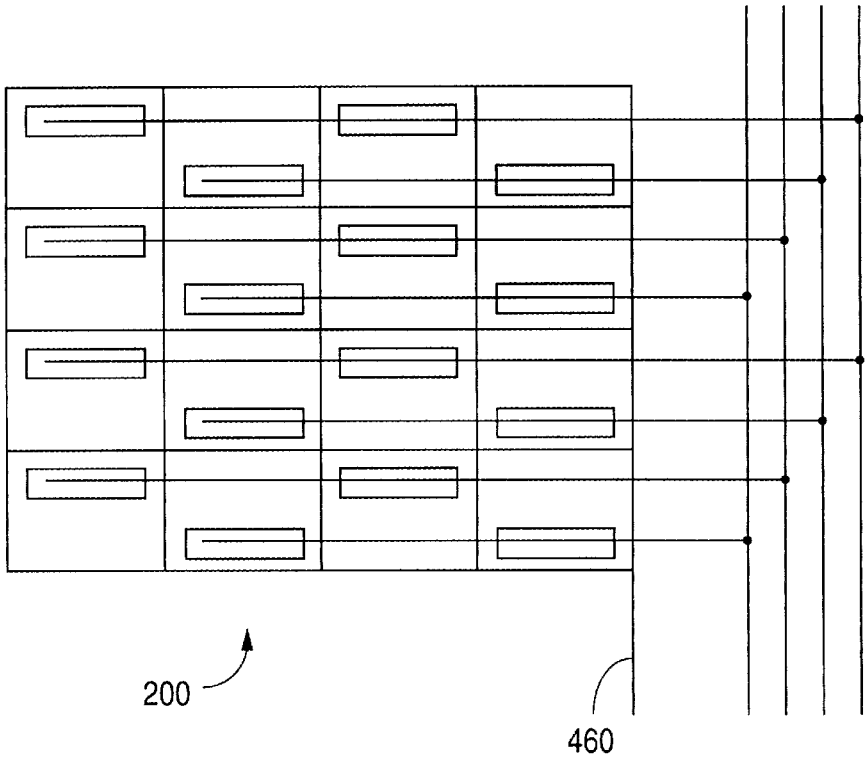
FIG. 4 is an enlarged plan view of the first embodiment with the addition of a bus bar.

FIG. 4 shows the addition of a bus bar 460 to the first embodiment of EL lamp 200 shown in FIG. 2. The bus bar provides a ground for the lamp. The bus bar surrounds the lamp on four sides, although other configurations are possible. In FIG. 4 the pixels are illustrated as squares with sides of 50 mils (not shown to scale), and other sizes are possible.

Figure 5:
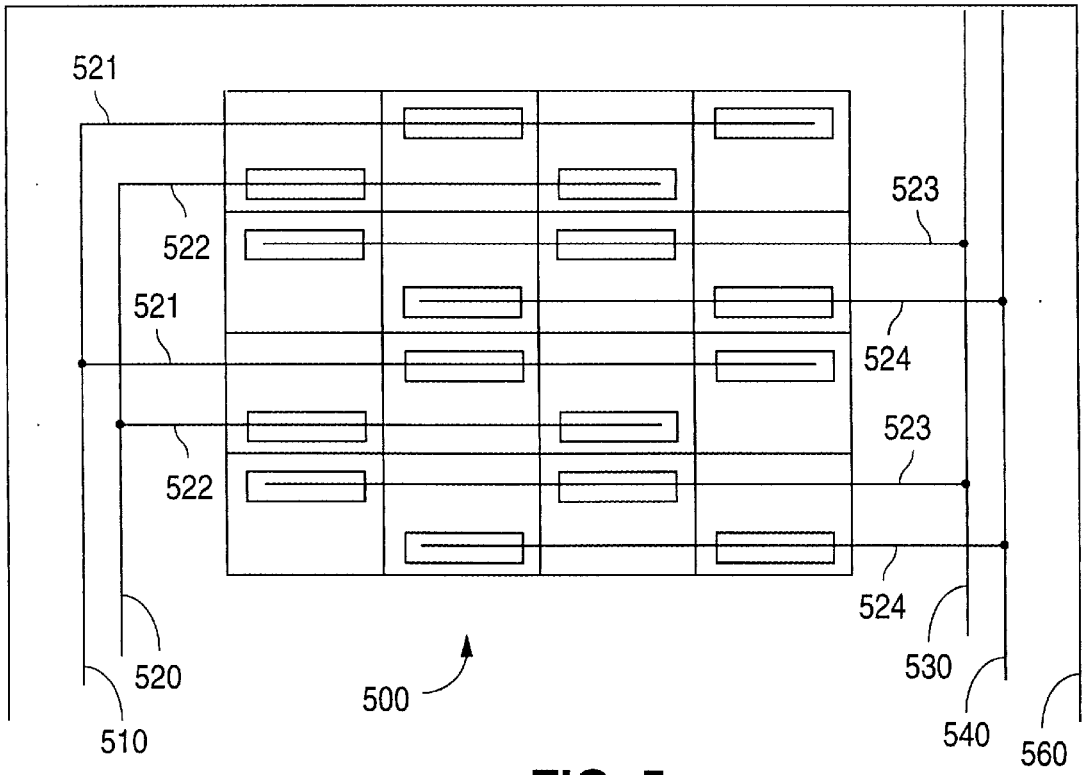
FIG. 5 is an enlarged plan view of a portion of an electroluminescent lamp arranged in a grid composed of four groups of four pixels according to a second embodiment of the present invention.
Figure 6A:
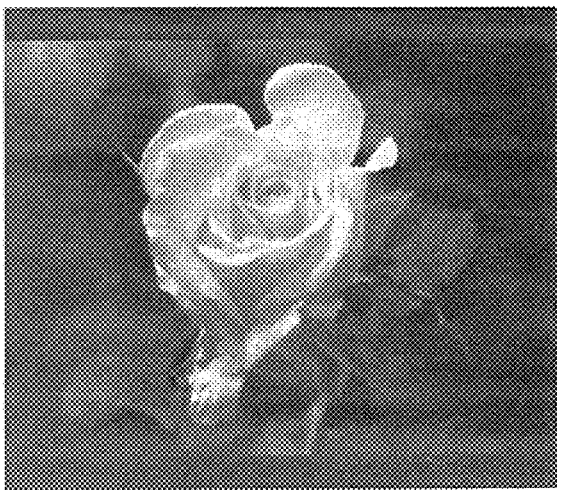
FIG. 6 illustrates four images to be animated on an electroluminescent lamp according to the first or second embodiments of the present invention.
Figure 6B:
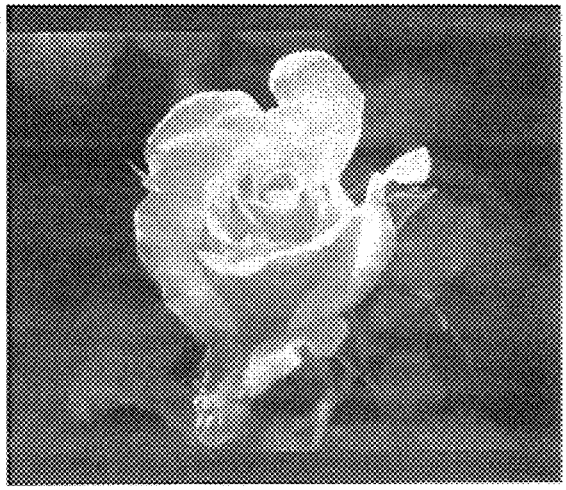
Figure 6C:
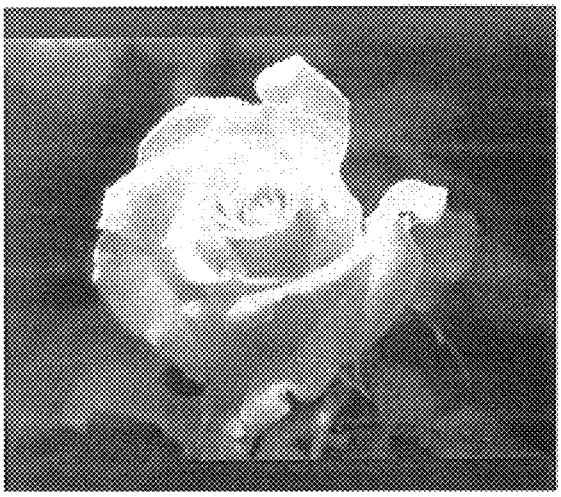
Figure 6D:
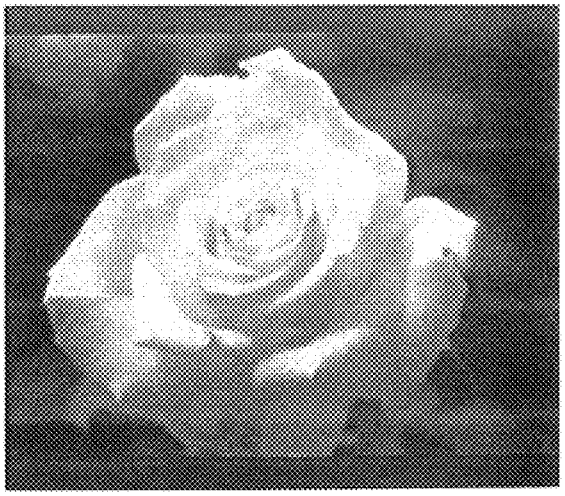
Figure 7A:
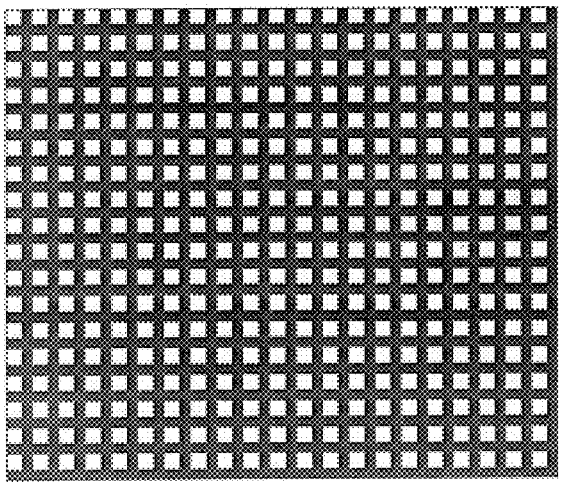
FIG. 7 illustrates four masks to be applied to the four images of FIG. 6.
Figure 7B:
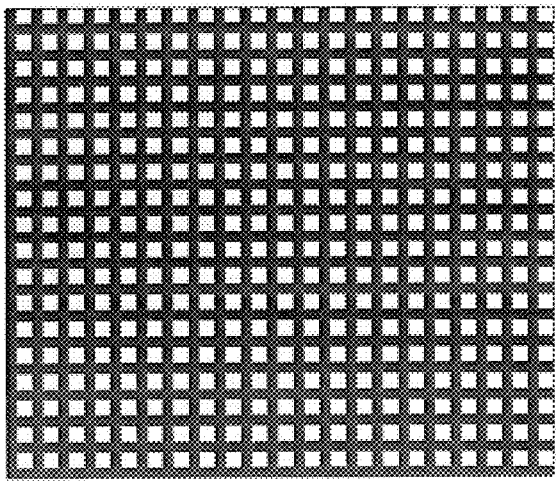
Figure 7C:
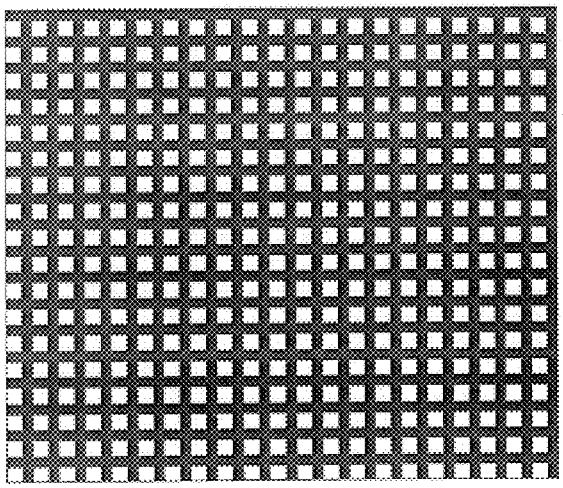
Figure 7D:
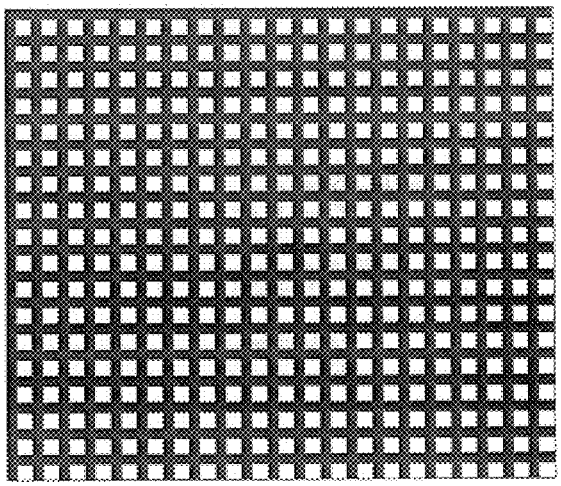
Figure 8A:
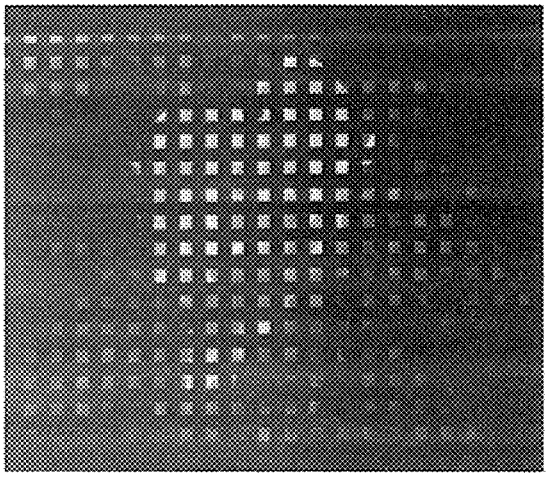
FIG. 8 illustrates the four images after application of the four masks of FIG. 7.
Figure 8B:
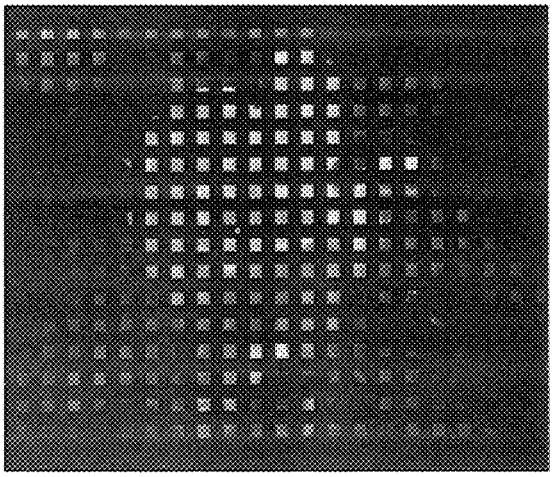
Figure 8C:
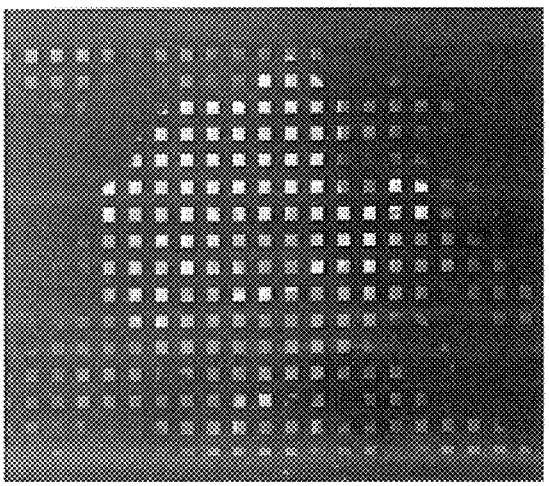
Figure 8D:
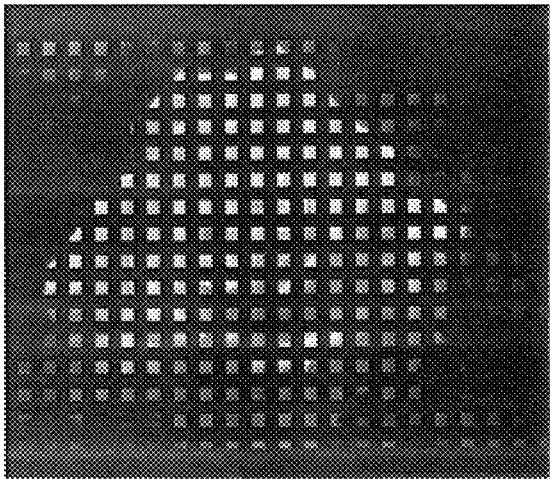

FIG. 5 shows a second embodiment of a four-pixel group EL lamp 500. The channels 510, 520, 530, and 540 are divided, with two on each side of EL lamp 500. This division reduces the number of channels that the trace leads 521, 522, 523, and 524 must cross over, which reduces the probability of short circuits. A bus bar 560 surrounds EL lamp 500 on three sides, but other arrangements are possible. The pixels are squares with sides of 50 mils, and other sizes are possible. The trace leads are about 10 mils in diameter, although other sizes are possible.

Upon these grids is placed a composite image, the creation of which is described below.

Composite Image Creation

A composite image, generally, is the combination of the images each of which results from activation of selected pixels of the lamp. For the embodiments described above having groups containing four pixels, the composite image is the combination of the four images that each result from activation of one-fourth of the total pixels.

FIGS. 6–9 exemplify how the composite image may be formed for use with the above-described embodiments. These figures show a sequence of images forming animation of a rose opening, but the images may be unrelated. The resolution, size and color of the images, and the resolution of the masks, may be varied according to need or desire. The choice of four images in a grid corresponds to the four pixels that make up the group in the EL lamps described above, but the present invention is not limited to this number of images or pixels.

FIG. 6 shows four frames (Frame 1, Frame 2, Frame 3, Frame 4) corresponding to four exemplary images 610, 620, 630, and 640. The frames show an opening flower from frame 1 to frame 4.

FIG. 7 shows four exemplary masks 710, 720, 730, and 740 to be applied to the four images of FIG. 6. Mask frame 710 is applied to image frame 610, etc. The non-dark areas of each mask allow a portion of the corresponding image to be seen, and the dark areas prevent the other portions of the corresponding image from being seen. As illustrated, each mask is 21 image pixels wide and 18 image pixels tall. Each mask is three-fourths dark, making the total image covered by the masks 42 by 36 image pixels.

FIG. 8 shows the four images of FIG. 6 after the masks of FIG. 7 have been applied. Image 810 corresponds to mask frame 710 and image frame 610. Image 820 corresponds to mask frame 720 and image frame 620, etc. Note that it is possible to perceive the flower even at the 21-by-18 image pixel resolution of the masks.

Figure 9A:
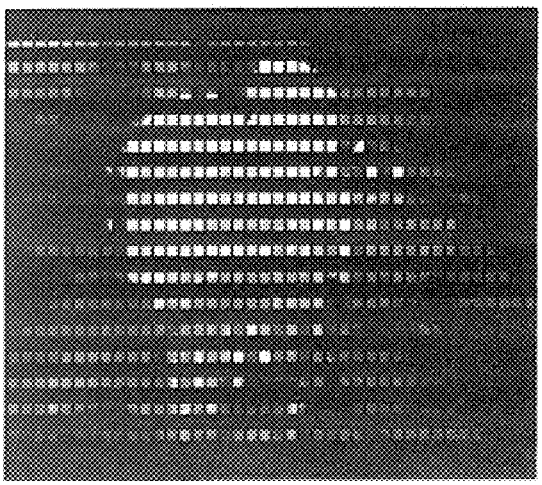
FIG. 9 illustrates a combination of the four masked images of FIG. 8.
Figure 9B:
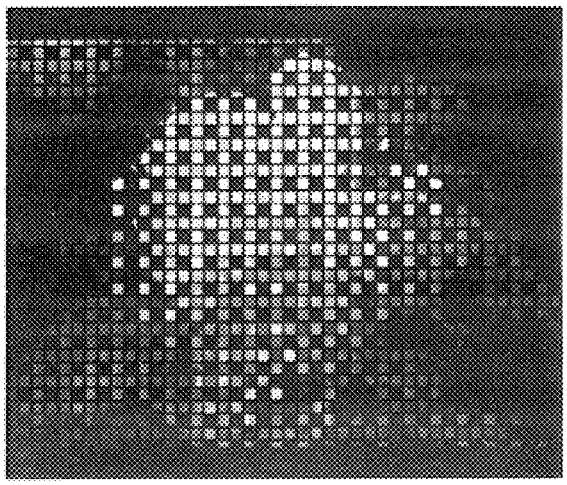
Figure 9C:
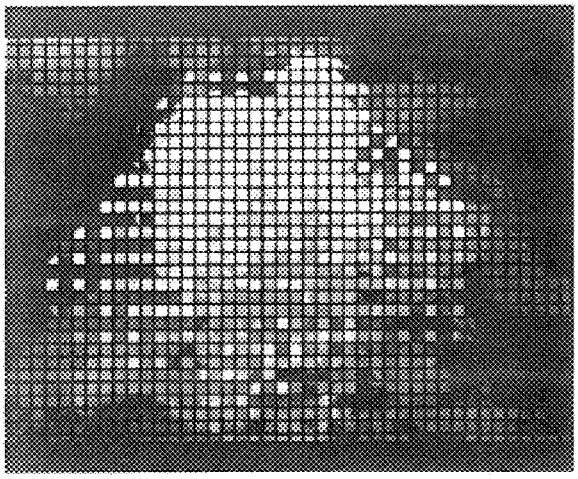

FIG. 9 shows how the images of FIG. 8 may be combined into one composite image. The upper-left image 912 shows the combination of the first masked image 810 and the second masked image 820. Note that half of the image pixels are now present. The upper-right image 913 shows the addition of the third masked image 830. Now three-fourths of the image pixels are present. The lower image 914, the composite image, shows the addition of the fourth masked image 840. All image pixels are now present. Lower image 914 shows that the images 810, 820, 830, and 840 are collocated together. Image 914 may also be described as the interweaving together of images 810, 820, 830, and 840.

For creating animated images of the rose opening, the composite image 914 may be placed on a suitably sized EL lamp according to the first or second embodiments as described above. The EL lamp may then cycle through the four sets 351, 352, 353, and 354 of pixels, i.e., selected pixels may be illuminated sequentially by powering the four channels in turn. Each set corresponds to one-fourth of the composite image 914. Each fourth of the composite image 914 is one of the masked images 810, 820, 830, and 840.

Thus, the activation of each set shows one of the masked images. In this manner the EL lamp displays what appears to be a flower opening.

Alternatively, the composite image may be various colors. Each channel would then activate a different color. The voltage of the channel may be adjusted to vary the color. More than one channel may be activated at the same time to display mixed colors. The pixels may be placed sufficiently close that a viewer may perceive the mixed color instead of the separate image pixels making up the color components.

The creation of the composite image may be accomplished with commercially available software, such as Corel CORELDRAW drawing program and Adobe PHOTOSHOP image editing program. Although this discussion references four images to correspond to the four images of FIGS. 6–9, similar methods will work with other numbers of images.

First, the four images to be combined are created in or imported into CORELDRAW. The Layers Manager feature is used to put a bitmap in the background and to put the four images in four other layers on top. Then a grid of a desired size and line thickness is added.

To view one of the frames, the other three frames are turned on and the grid is made black, with the grid on top. Then the grid and the bitmap are exported together with a common bitmap format to be put into PHOTOSHOP. These two steps are repeated for the other three frames. The order of viewing and exporting the frames does not matter.

In PHOTOSHOP, the exported images are opened, then copied and pasted in frame number order onto individual layers, making sure the images are aligned directly on top of each other. For each frame, all the pixels except t he one-fourth to keep for the masked frame are then erased. Finally, the layers are merged together.

The composite image may then be printed on a sheet of translucent or transparent material, which then may be placed on the EL lamp. A number of composite images may be printed for the same lamp, allowing the images displayed by the lamp to be easily changed by replacing the composite image on the lamp.

Additional Features

Figure 10:
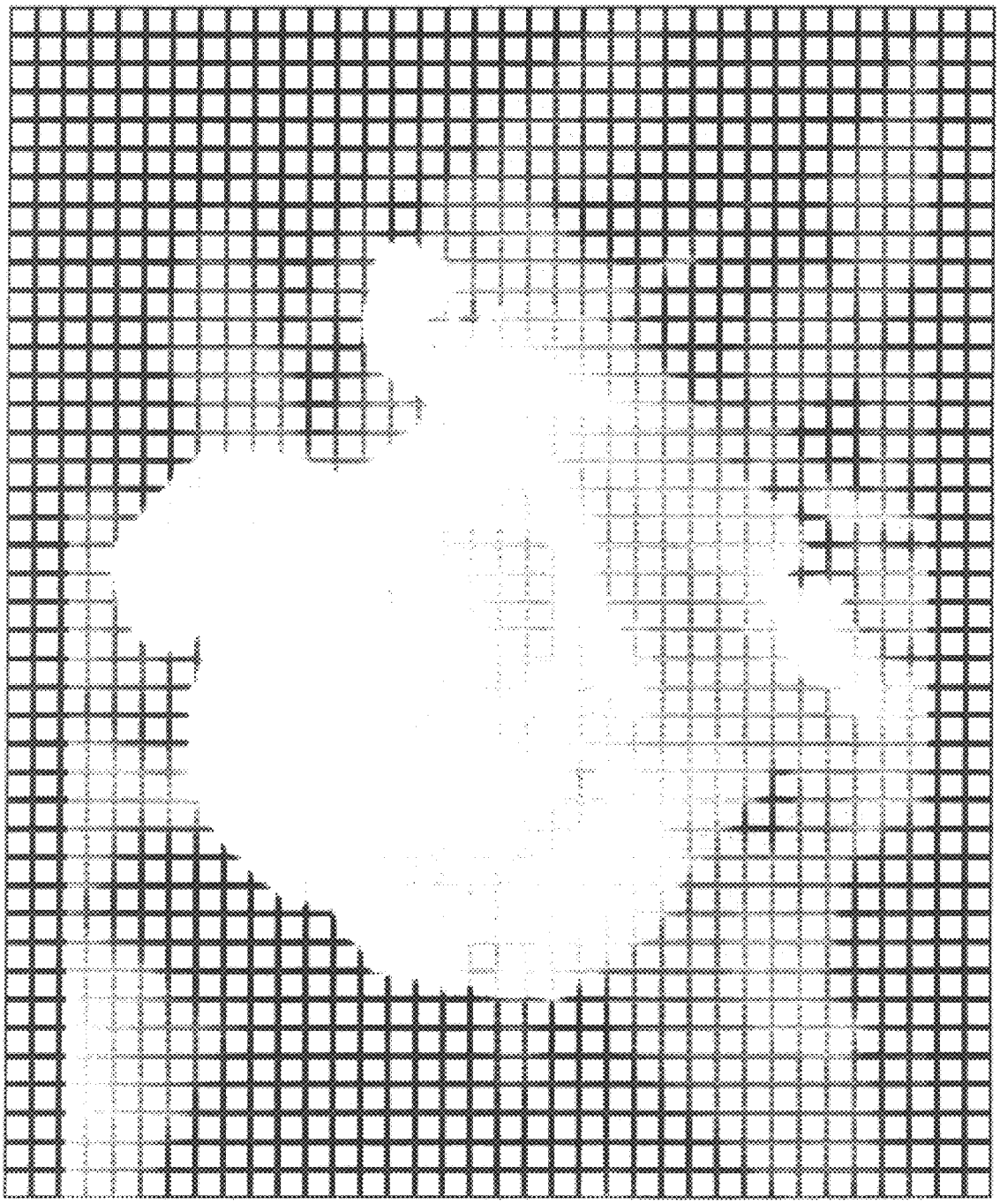
FIG. 10 illustrates an image applied to spaces between the pixels of FIG. 3A.

FIG. 10 shows that an additional image may be placed on the grid lines. Because light from the lamp is not emitted from the grid lines, this additional image may be viewable by reflected ambient light when the lamp is off, such as during the daytime. For example, with the four-image display described above, the image of FIG. 10 is viewable during daytime. Then at night, the lamp may be activated and the lamp displays the four-image animation sequence. The brightness of the active pixels may provide sufficient illumination such that a viewer does not perceive any light reflected off the additional image.

This image may be placed on the grid lines using CORELDRAW and PHOTOSHOP as described above.

Figure 11:
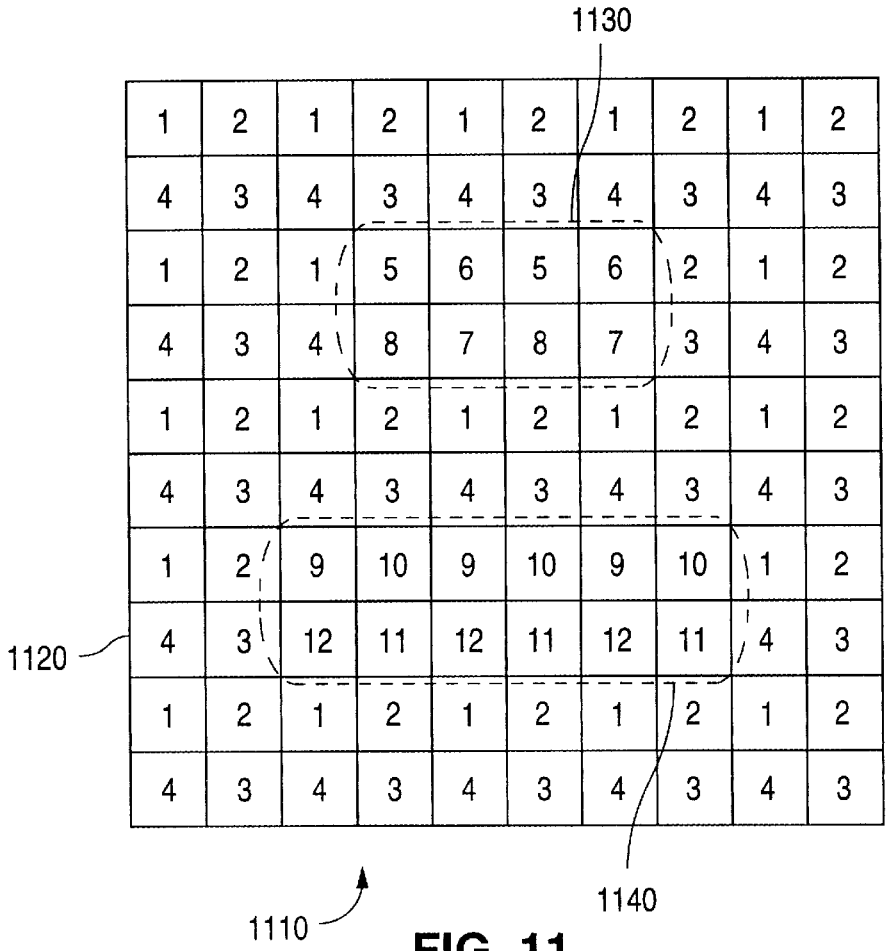
FIG. 11 is a schematic view of a grid composed of twelve pixels in three groups of four.

FIG. 11 shows how twelve channels may be formed as three collections 1120, 1130, and 1140 of twelve sets of groups with four pixels (displaying the numbers 1–4, 5–8, and 9–12, respectively). Each group of four is controlled by its own four trace leads, as described above. Each collection is controlled by its own four channels. Imagine that the grid 1110 of FIG. 11 may be used to animate a face. Collection 1130 may display either or both of the eyes. Collection 1140 may display the mouth. Collection 1120 may display the rest of the face. Because each collection may display four separate images and there are three collections, the face displayed may assume 64 ($4^3$=64) configurations of the eyes, mouth, and rest of the face.

Figure 12A:
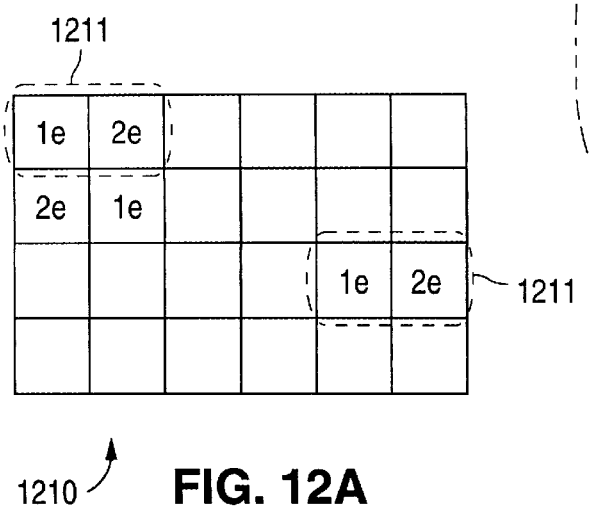
FIGS. 12A–12C are schematic views of grids containing two, five, or nine pixels in a group.
Figure 12B:
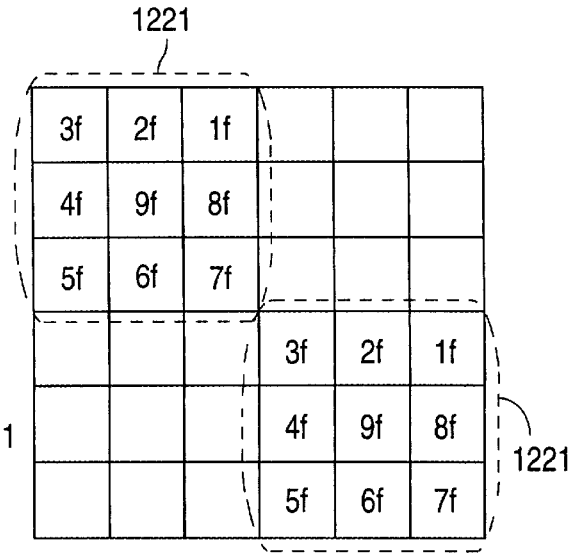
Figure 12C:
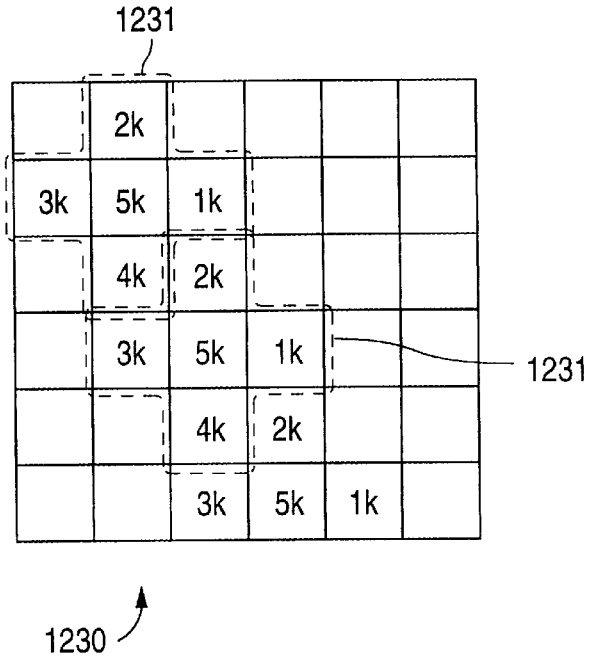

FIGS. 12A, 12B and 12C show how the four-image grid format described above may be modified to contain different numbers of images. FIG. 12A shows that the grid 1210 may contain two images, with two sets of pixels 1e–2e. The 1e–2e sequence in each group 1211 is shown staggered, but the set of pixels 1e and the set of pixels 2e may be in a column or row as desired. FIG. 12B shows that the grid 1220 may contain nine images, with nine sets of pixels 1f–9f. The 1f–9f sequence in each group 1221 is shown in a "G" shape, but many other arrangements are possible. FIG. 12C shows that the grid 1230 may contain five images, with five sets of pixels 1k–5k. The 1k–5k sequence in each group 1231 is shown in a generally counter-clockwise shape, but other arrangements are possible.

Figure 13A:
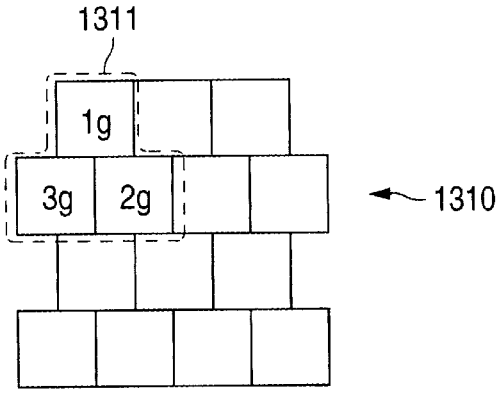
FIGS. 13A–13C are schematic views of staggered grids containing three, four, or seven pixels in a group.
Figure 13B:
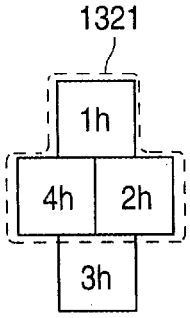
Figure 13C:
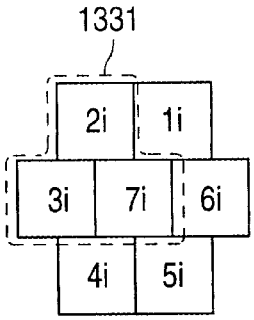

FIGS. 13A, 13B, and 13C show a staggered grid implementation. In these figures, grid 1310 is staggered such that every other row is shifted a half-pixel. The grid may also be staggered such that every other column is shifted a half-pixel. FIG. 13A shows that grid 1310 may contain three images, with three sets of pixels 1g–3g. The 1g-2g-3g sequence is shown such that the three pixels in the group 1311 are closely adjacent, but this is not required. Note that the pixels 1g–3g form a rough triangle shape. FIG. 13B shows a staggered implementation of a four-pixel group 1321, with four sets of pixels 1h–4h. Every pixel in the group is shown closely adjacent to the other pixels in the group, but this is not necessary. Note that the pixels 1h–4h form a rough diamond shape. FIG. 13C shows a staggered implementation of a seven-pixel group 1331, with seven sets of pixels 1i–7i. The pixels in the group form a "G" shape, but this is not a requirement. Note that the pixels 1i–7i form a rough circular shape.

Figure 14A:
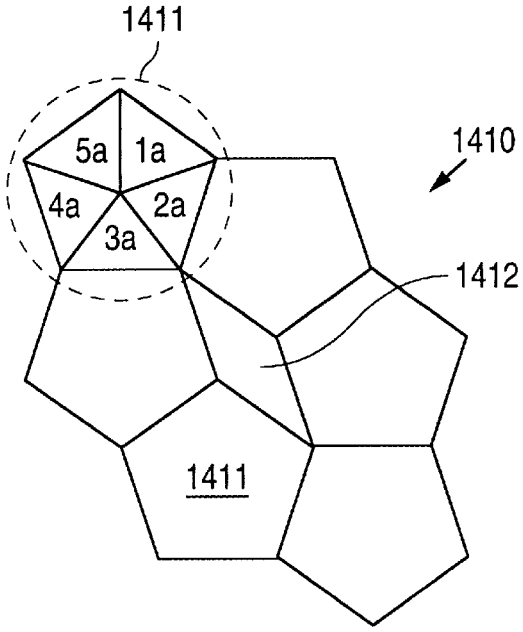
FIGS. 14A–14C are schematic views of geometric grids containing five, six, or eight pixels in a group.
Figure 14B:
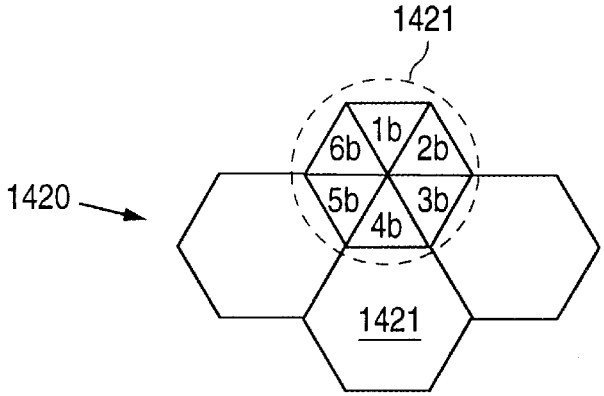
Figure 14C:
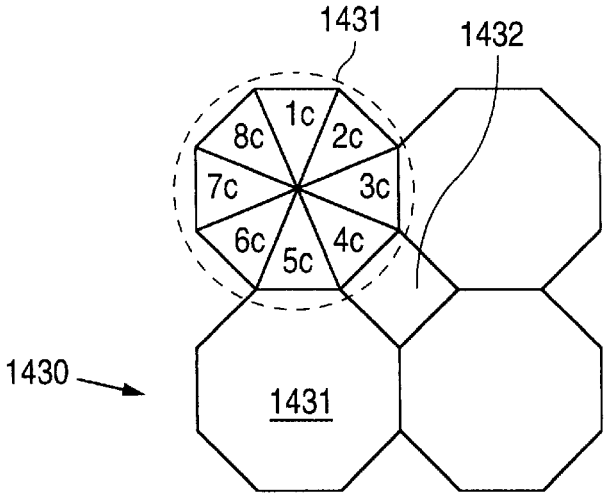

FIGS. 14A, 14B and 14C show geometric grid implementations. FIG. 14A shows a pentagonal grid 1410 with five sets of pixels 1a–5a being portions of a group 1411 in the shape of a pentagon. FIG. 14B shows a hexagonal grid 1420 with six sets of pixels 1b–6b being portions of a group 1421 in the shape of a hexagon. FIG. 14C shows an octagonal grid 1430 with eight sets of pixels 1c–8c being portions of a group 1431 in the shape of an octagon. Although FIGS. 14A and 14C show portions 1412 and 1432 of the grid containing no pixels, these portions may be assigned to existing pixel sets, may be used to form other groups, or may be used to contain the additional image placed on the grid lines as shown in FIG. 10, among other uses. The shape of each pixel is defined by the area between two line segments from adjacent vertices of the polygonal grid to its center.

Figure 15:
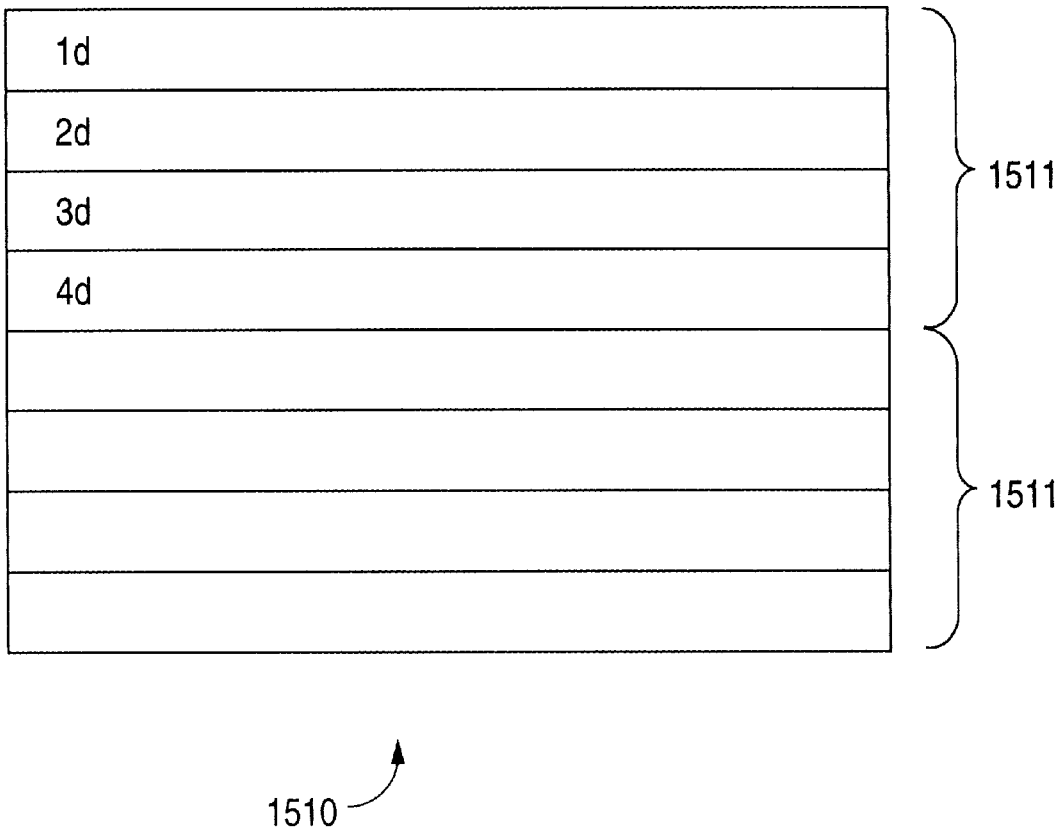
FIG. 15 is a schematic view of a grid containing four pixel lines in a group.

FIG. 15 shows a line grid 1510. Grid 1510 has a number of groups 1511 of four pixel lines 1d–4d in rows, allowing four images to be shown. More or fewer pixel lines in a group may be implemented. The pixel lines may also be in columns.

Although the pixel arrangements described above have described groups containing approximately equal numbers of pixels of approximately the same size, this is not required. For example, some applications may require only a few pixels to display one or more of the images. In such a case the pixels assigned to other images may be increased. Similarly, the pixels assigned to other images may be decreased if desired for an image. A similar function may be performed in the embodiment shown in FIG. 3A by activating two channels at once.

Another feature that may be added to the pixel display according to the present invention is thermochromic shutters. Thermochromic shutters used in EL lamps are described in U.S. Provisional application Ser. No. 60/079,207, filed Mar. 24, 1998, entitled "Electroluminescent Lamp Including Thermochromic Shutters", commonly owned by the assignee of the present application, the disclosure of which is hereby incorporated by reference. Thermochromic shutters would allow portions of the lamp to be selectively obscured without significantly increasing the thickness of the lamp.

An additional feature that may be added to the pixel display according to the present invention is sound. The sound may be synchronized with the channels to output different sounds with the changing images. For example, with the face described above with reference to FIG. 11, the sounds could be synchronized with the animated mouth.

Example Applications

An example application is a billboard. The billboard may be formed from one large EL lamp or from several smaller EL lamps. Each EL lamp may have a composite image as described above. The grid lines may have an additional image as described above regarding FIG. 10.

When the billboard is unpowered, for example, in daytime, a viewer may see the additional image by reflected ambient light. When the billboard is powered, for example, at night, the billboard may display the images shown by the pixels. These images may form animation, or instead may be unrelated. For example, different advertisements may be integrated onto the same composite image. These advertisements may be unrelated, so the billboard would display each image for a relatively longer period than the animation period.

The images may be an extension of the additional image. For example, during the daytime the billboard may display, as the additional image, a person in a race stance. At night, the images may show an animated sequence of the person running.

Another example application is a store display. The store display may be formed from one EL lamp, or another EL lamp may be placed on the back so that the store display shows images on the front and back. The store display may show the face of a celebrity which may be animated. The celebrity's voice may be synchronized with the animation to describe the product featured by the store display.

It should be understood that various alternatives to the embodiments of the invention described herein may be employed in practicing the invention. It is intended that the following claims define the scope of the invention and that structures within the scope of these claims and their equivalents are covered thereby.

What is claimed is:

1. An apparatus for displaying a sequence of images on an electroluminescent lamp, said apparatus comprising:

(a) an electroluminescent lamp including a front electrode and a plurality of pixels, said pixels being independently illuminable portions of said electroluminescent lamp, each pixel having an electroluminescent material and a rear electrode;

(b) a plurality of trace leads connected to said rear electrodes, wherein each rear electrode is connected to one trace lead, and wherein each trace lead is connected to more than one rear electrode; and (c) an overlay adjacent to said electroluminescent lamp, said overlay including:

(1) a translucent or transparent material; and (2) a plurality of images interwoven together on said translucent or transparent material, each image corresponding to respective pixels on said electroluminescent lamp;

wherein power supplied to said front electrode and selected rear electrodes creates an electric field therebetween, whereby pixels to which power is supplied are illuminated to display one of said images, and wherein a sequence of said images may be displayed by sequentially supplying power to other of said rear electrodes.

2. The apparatus of claim 1, further comprising:

(d) a plurality of channels connected to said trace leads, wherein each channel is connected to more than one trace lead.

3. The apparatus of claim 2, wherein:

the number of channels is four; and the number of images is four.

4. The apparatus of claim 3, wherein:

each of said pixels has a square shape.

5. The apparatus of claim 2, wherein said sequence of said images forms animation.

6. The apparatus of claim 2, wherein:

each of said pixels has a rectangular shape.

7. The apparatus of claim 2, wherein:

each of said pixels has a square shape;

the number of channels is two; and the number of images is two.

8. The apparatus of claim 2, wherein:

each of said pixels has a square shape;

the number of channels is three; and the number of images is three.

9. The apparatus of claim 2, wherein:

the number of channels is four, wherein two channels are on a side of said electroluminescent lamp opposite the two other channels; and the number of images is four.

10. The apparatus of claim 2, wherein:

each of said pixels has a square shape;

the number of channels is five; and the number of images is five.

11. The apparatus of claim 2, wherein:

each of said pixels has a shape of a section defined by two line segments from adjacent vertices through a center of a pentagon;

the number of channels is five; and the number of images is five.

12. The apparatus of claim 2, wherein:

each of said pixels has a shape of a section defined by two line segments from adjacent vertices through a center of a hexagon;

the number of channels is six; and the number of images is six.

13. The apparatus of claim 2, wherein:

each of said pixels has a square shape;

the number of channels is seven; and the number of images is seven.

14. The apparatus of claim 2, wherein:

each of said pixels has a shape of a section defined by an area between two line segments from adjacent vertices through a center of an octagon;

the number of channels is eight; and the number of images is eight.

15. The apparatus of claim 2, wherein:

each of said pixels has a square shape;

the number of channels is nine; and the number of images is nine.

16. The apparatus of claim 2, wherein:

more than one channel is powered at once.

17. The apparatus of claim 2, wherein said overlay further comprises:

(3) a plurality of grid lines separating said plurality of images interwoven together, said grid lines having an additional image viewable when said pixels do not emit light.

18. A method of displaying a sequence of images on an electroluminescent lamp, comprising the steps of:

providing an electroluminescent lamp including a plurality of pixels, said pixels being independently illuminable portions of said electroluminescent lamp;

providing a plurality of images interwoven together, wherein illumination of a set of said pixels displays a corresponding image; and sequentially illuminating each set to display a sequence of said images.

19. The method of claim 18, wherein:

the step of sequentially illuminating each set comprises the step of sequentially illuminating each set to display a sequence of said images to form animation.

20. The method of claim 18, wherein:

the step of sequentially illuminating each set comprises the step of sequentially illuminating more than one set simultaneously to display a sequence of said images.

* * * * *